US010248069B2

(12) United States Patent
Mugita et al.

(10) Patent No.: US 10,248,069 B2
(45) Date of Patent: Apr. 2, 2019

(54) DEVELOPING APPARATUS HAVING A RIB PORTIONED CONVEYANCE SCREW

(71) Applicant: CANON KABUSHIKI KAISHA, Tokyo (JP)

(72) Inventors: Naoki Mugita, Toride (JP); Toshihisa Yago, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/685,187

(22) Filed: Aug. 24, 2017

(65) Prior Publication Data

US 2018/0059606 A1 Mar. 1, 2018

(30) Foreign Application Priority Data

Aug. 31, 2016 (JP) ..... 2016-170336

(51) Int. Cl.
*G03G 15/08* (2006.01)
*G03G 15/00* (2006.01)

(52) U.S. Cl.
CPC ..... *G03G 15/556* (2013.01); *G03G 15/0853* (2013.01); *G03G 15/0891* (2013.01); *G03G 2215/0805* (2013.01); *G03G 2215/0838* (2013.01)

(58) Field of Classification Search
CPC ..... G03G 15/0824; G03G 15/0829; G03G 15/0849; G03G 15/0853; G03G 15/0891; G03G 15/556; G03G 2215/0805; G03G 2215/0838; G03G 2215/0888
See application file for complete search history.

(56) References Cited

U.S. PATENT DOCUMENTS 5,111,247 A * 5/1992 Nichols ..... G03G 15/0849 366/142
7,885,581 B2 2/2011 Oshige et al.
7,953,331 B2 5/2011 Oshige et al.
2002/0159781 A1* 10/2002 Hatori ..... G03G 15/0891 399/30
2016/0209777 A1 7/2016 Mugita et al.
2017/0108797 A1* 4/2017 Mandai ..... G03G 15/0824
(Continued)

FOREIGN PATENT DOCUMENTS

JP 2008-102492 A 5/2008
JP 2009-047714 A 3/2009
(Continued)

OTHER PUBLICATIONS

Toshihisa Yago, U.S. Appl. No. 15/604,968, filed May 25, 2017.

*Primary Examiner* — Sophia S Chen
(74) *Attorney, Agent, or Firm* — Venable LLP

(57) ABSTRACT

A developing apparatus includes a developer bearing member configured to bear and convey a developer containing toner and carrier, a first conveyance screw arranged in a first chamber to convey the developer, a second conveyance screw arranged in the second chamber to convey the developer, and a permeability sensor configured to detect a permeability of the developer. A detection portion of the sensor is arranged below a rotational axis of the second conveyance screw, and a rib portion is formed so as to protrude in a radial direction from a rotation shaft of the second conveyance screw for supplying the developer toward the detection portion.

6 Claims, 7 Drawing Sheets

(56) References Cited

U.S. PATENT DOCUMENTS

| | | | | |
|---|---|---|---|---|
| 2017/0146927 | A1* | 5/2017 | Shigehiro ..... | G03G 15/0891 |
| 2017/0227886 | A1* | 8/2017 | Kato ..... | G03G 15/0849 |
| 2017/0227889 | A1* | 8/2017 | Sekura ..... | G03G 15/0824 |

FOREIGN PATENT DOCUMENTS

| | | | |
|---|---|---|---|
| JP | 2010-191357 | A | 9/2010 |
| JP | 2011-022514 | A | 2/2011 |

* cited by examiner

DEVELOPING APPARATUS HAVING A RIB PORTIONED CONVEYANCE SCREW

BACKGROUND OF THE INVENTION

Field of the Invention

The present invention relates to a developing apparatus used in an image forming apparatus adopting an electrophotographic system or an electrostatic recording system.

Description of the Related Art

Hitherto, image forming apparatuses adopting an electrophotographic system are widely applied as copying machines, printers, plotters, facsimiles, and multifunction machines having a plurality of these functions. In these types of image forming apparatuses, toner charged in a developing apparatus is approximated to an image bearing member, and the toner is electrostatically attached to an electrostatic latent image on the image bearing member to develop the image, by which the image is formed. A developing apparatus is disposed in the image forming apparatus to develop the electrostatic latent image. A two-component developer including toner and carrier is used to develop the image in the developing apparatus, and the toner image is obtained by transferring toner from the developer borne on a developer bearing member to an electrostatic latent image on the image bearing member. The developer in the developing apparatus is conveyed by a conveyance screw serving as one example of an agitating conveyance member. At that time, toner density is detected by a density detection unit, such as a toner density detection sensor. A control unit of the image forming apparatus supplies the developer to the developing apparatus to realize an appropriate toner quantity based on the detected toner density.

A bulk density of toner within the developer is varied by fluctuation of surrounding environment and toner charge quantity, by which a detection result of the density detection unit may vary and erroneous detection may be output even in a state where the toner density is fixed. Therefore, stable conveyance of developer must be performed at a portion facing a detection surface of the density detection unit, and a plate-like agitating member may be disposed at a portion of the conveyance screw facing the detection surface of the density detection unit.

However, a gap is formed between the detection surface of the density detection unit and the agitating member of the developing apparatus, and the developer existing in the gap may be pressed onto the detection surface of the density detection unit at an end portion of the agitating member, causing accumulation of the developer. The bulk density of the accumulated developer is greater than the developer surrounding the accumulated developer and being conveyed, and the density detection unit may output erroneous detection. Especially if fluidity of the developer is reduced by long term use, the possibility of occurrence of erroneous detection is increased.

Recently, in order to downsize the image forming apparatus, there are cases where a density detection unit is disposed below a developer container. The lower the position of the density detection unit is, the more difficult it becomes to agitate and convey the developer on the detection surface of the density detection unit, and erroneous detection tends to be induced. If the density detection unit performs erroneous detection as described above, it may become impossible to maintain an appropriate toner charge quantity, and image defects such as fogging may be induced. In order to solve this problem, a technique is developed (refer to Japanese Unexamined Patent Application Publication No. 2011-22514) in which a magnetic plate is provided on an agitating member, a magnetic brush is formed by the magnetic carrier in the developer, and the magnetic brush is used to remove developer accumulation at a portion facing the detection surface of a density detection unit.

However, in the developing apparatus of the above-described Japanese Unexamined Patent Application Publication No. 2011-22514, a magnetic plate is provided on the agitating member, such that a fragment of the magnetic plate may be mixed into the developer, and abnormal image may occur. Further, since a magnetic plate is provided on the agitating member, the density detection unit detects the magnetic plate itself, and detection accuracy may be deteriorated. Moreover, since the magnetic plate is provided on the agitating member, costs may be raised by the addition of components. According to the above drawbacks, there were demands for a developing apparatus capable of removing accumulation of developer on the detection surface of the density detection unit, and enabling highly accurate detection of developer density.

SUMMARY OF THE INVENTION

According to one aspect of the present invention, a developing apparatus including a developer container configured to store a developer containing toner and carrier, a conveyance portion comprising a shaft portion supported rotatably within the developer container, and a conveying blade configured to rotate integrally with the shaft portion and convey the developer within the developer container in a conveyance direction of the developer along rotation of the shaft portion, a density detection unit arranged such that a detection surface exposed inside the developer container faces the conveyance portion, and configured to detect a density of the toner in the developer conveyed inside the developer container, and a projected portion projected from the shaft portion in a radial direction of the shaft portion such that a position of the projected portion overlaps with the detection surface in an axial direction of the shaft portion. The projected portion is shaped such that a part between both end portions of the projected portion in the axial direction is positioned upstream in a direction of rotation of the conveyance portion than the both end portions.

Further features of the present invention will become apparent from the following description of exemplary embodiments with reference to the attached drawings.

DESCRIPTION OF THE EMBODIMENTS

Now, an embodiment of the present invention will be described in detail with reference to FIGS. 1 through 5B. A tandem-type full-color printer is described as an example of an image forming apparatus 1 according to the present embodiment. However, the present invention is not restricted to a tandem-type image forming apparatus 1, and it can be other types of image forming apparatuses, or can be monochrome or mono-color printers instead of full-color printers. Further, the present invention can be implemented for various purposes of use, such as printers, various printing machines, copying machines, facsimiles, and multifunctional machines. Further according to the present embodiment, the image forming apparatus 1 includes an intermediate transfer belt 44*b*, and adopts a system in which toner images of respective colors are primarily transferred from a photosensitive drum 51 to the intermediate transfer belt 44*b*, and thereafter, a superposed toner image of the respective colors is collectively secondarily transferred to a sheet S. However, the present invention is not restricted to this example, and it can adopt a system in which toner images are directly transferred from the photosensitive drum onto the sheet conveyed via a sheet conveyance belt.

Figure 1:
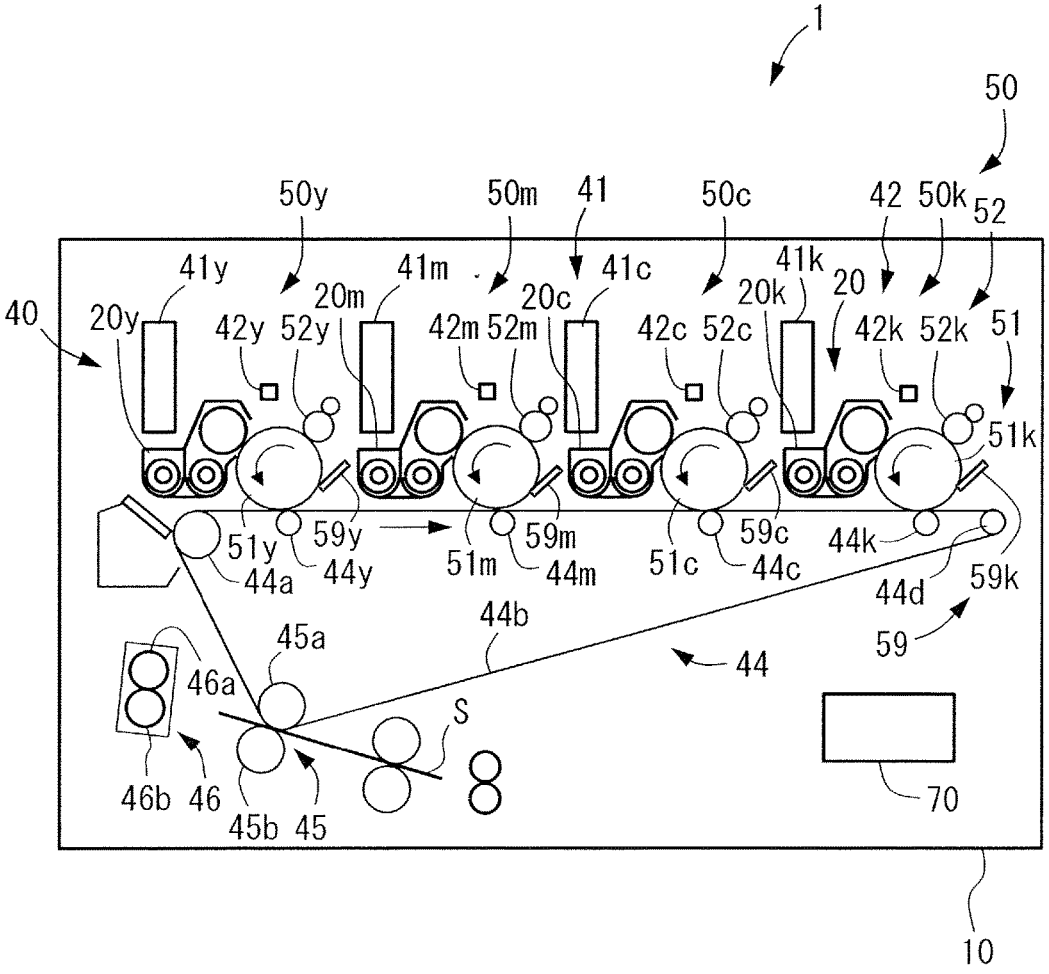
FIG. 1 is a cross-sectional view illustrating a schematic configuration of an image forming apparatus according to an embodiment.

As illustrated in FIG. 1, the image forming apparatus includes an apparatus body 10, a sheet feeding unit not shown, an image forming portion 40, a sheet conveyance portion and a sheet discharge portion not shown, and a controller 70. A toner image is formed on a sheet S serving as a recording material, and specific examples of the sheet S include normal paper, a synthetic resin sheet serving as substitute of normal paper, thick paper, OHP sheet, and so on.

The image forming portion 40 includes image forming units 50*y*, 50*m*, 50*c* and 50*k*, toner bottles 41*y*, 41*m*, 41*c* and 41*k*, exposing units 42*y*, 42*m*, 42*c* and 42*k*, an intermediate transfer unit 44, a secondary transfer portion 45, and a fixing portion 46. The image forming portion 40 is configured to form an image on a sheet S based on image information. The image forming apparatus 1 of the present embodiment corresponds to a full-color image, and the image forming units 50*y*, 50*m*, 50*c* and 50*k* are provided individually with a similar configuration for the four respective colors of yellow (y), magenta (m), cyan (c) and black (k). Therefore, color identifiers are added after the reference numbers for the respective configuration of the four toner colors in FIG. 1, but in FIGS. 2 and 3 and in the specification, the configuration may be described without the color identifiers.

In the present embodiment, a two-component developer, which is a mixture of nonmagnetic toner having negative chargeability and magnetic carrier, is used as developer. Toner can be generated by including coloring agents, wax components and so on in resin such as polyester or styrene, and grinding or polymerizing the same. A carrier is generated by applying a resin coating to a surface layer of a core composed of ferrite particles or resin particles formed by kneading magnetic powder.

The image forming unit 50 includes four image forming units 50*y*, 50*m*, 50*c* and 50*k* configured to form toner images of four colors. The respective image forming units 50 are equipped with a photosensitive drum 51 (51*y*, 51*m*, 51*c* and 51*k*) configured to form toner images, a charging roller 52 (52*y*, 52*m*, 52*c* and 52*k*), a developing apparatus 20 (20*y*, 20*m*, 20*c* and 20*k*), and a cleaning blade 59 (59*y*, 59*m*, 59*c* and 59*k*).

The photosensitive drum 51 has a photosensitive layer designed to have negative charging polarity arranged on an outer circumference surface of an aluminum cylinder, and rotates in a direction of an arrow at a predetermined processing speed (peripheral speed). The charging roller 52 contacts the surface of the photosensitive drum 51, and charges the surface of the photosensitive drum 51 uniformly. After the charge, an electrostatic image based on image information via the exposing units 42*y*, 42*m*, 42*c* and 42*k* is formed on the surface of the photosensitive drum 51. The photosensitive drum 51 bears the formed electrostatic image and rotates, by which the image is developed by toner in the developing apparatus 20. The detailed configuration of the developing apparatus 20 will be described later.

The developed toner image is primarily transferred to the intermediate transfer belt 44*b* described later. After primary transfer, the surface of the photosensitive drum 51 is discharged by a pre-exposure portion not shown. The cleaning blade 59 is arranged to contact the surface of the photosensitive drum 51, and cleans residuals such as transfer residual toner remaining on the surface of the photosensitive drum 51 after primary transfer.

The intermediate transfer unit 44 is arranged below the image forming units 50*y*, 50*m*, 50*c* and 50*k*. The intermediate transfer unit 44 includes a plurality of rollers such as a driving roller 44*a*, a driven roller 44*d*, and primary transfer rollers 44*y*, 44*m*, 44*c* and 44*k*, and an intermediate transfer belt 44*b* wound around these rollers. The primary transfer rollers 44*y*, 44*m*, 44*c* and 44*k* are respectively arranged to face the photosensitive drums 51*y*, 51*m*, 51*c* and 51*k*, and abutted against the intermediate transfer belt 44*b*.

By applying a transfer bias of positive polarity to the intermediate transfer belt 44*b* from the primary transfer rollers 44*y*, 44*m*, 44*c* and 44*k*, toner images having negative polarity formed on the photosensitive drums 51*y*, 51*m*, 51*c* and 51*k* are sequentially transferred to the intermediate transfer belt 44*b* in a superposed manner. The intermediate transfer belt 44*b* receives transfer of toner images formed by developing the electrostatic images on the surface of the photosensitive drums 51*y*, 51*m*, 51*c* and 51*k*, and moves.

The secondary transfer portion 45 includes a secondary transfer inner roller 45*a* and a secondary transfer outer roller 45*b*. In a state where a secondary transfer bias of positive polarity is applied to the secondary transfer outer roller 45*b*, a full-color image formed on the intermediate transfer belt 44*b* is transferred to the sheet S. The fixing portion 46 includes a fixing roller 46*a* and a pressure roller 46*b*. A sheet S is nipped and conveyed between the fixing roller 46*a* and the pressure roller 46*b*, by which the toner image transferred to the sheet S is heated and pressed, and fixed to the sheet S.

Figure 2:
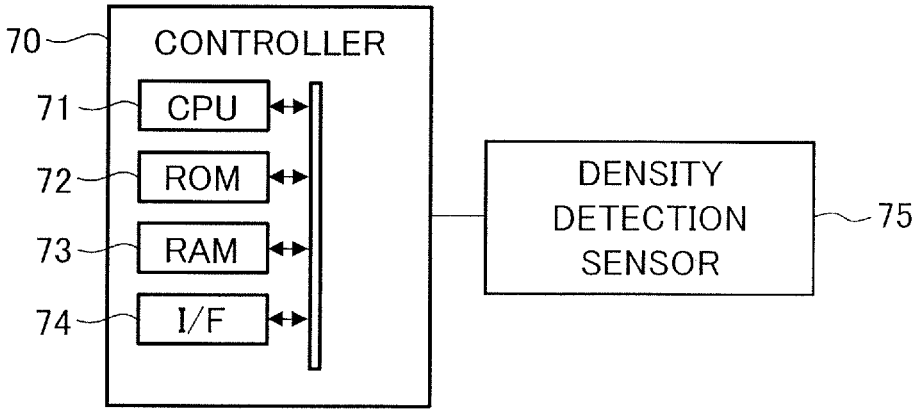
FIG. 2 is a control block diagram illustrating an outline of the image forming apparatus according to the embodiment.

The controller 70 is configured of a computer, and as illustrated in FIG. 2, the controller 70 includes a CPU 71, a ROM 72 storing programs for controlling various units, a RAM 73 temporarily storing data, and an input/output circuit (I/F) 74 for performing input/output of signals with the exterior. The CPU 71 is a microprocessor controlling the entire image forming apparatus 1, and it is a main subject of a system controller. The CPU 71 is connected via the input/output circuit 74 to the image forming portion 40 or an operating portion not shown, to communicate signals with respective portions and control the operations thereof. A density detection sensor 75 described later is connected to the controller 70. The ROM 72 includes a nonvolatile memory, and stores an image forming condition including a relative humidity and a time thereof. The CPU 71 writes the image forming condition into the ROM 72, or reads the image forming condition from the ROM 72 and utilizes the information.

Now, an image forming operation according to the image forming apparatus 1 adopting the above configuration will be described.

As illustrated in FIG. 1, in a state where the image forming operation is started, at first, the photosensitive drum 51 rotates and the surface of the photosensitive drum 51 is charged by the charging roller 52. Then, laser beams are irradiated from the exposing units 42*y*, 42*m*, 42*c* and 42*k* to the photosensitive drum 51 based on image information, and an electrostatic latent image is formed on the surface of the photosensitive drum 51. By having toner adhere to the electrostatic latent image, the image is developed as toner image and visualized, and transferred to the intermediate transfer belt 44*b*.

Meanwhile, along with the operation of forming the toner image, an uppermost sheet S in a sheet cassette is separated and fed. At a matched timing with the toner image on the intermediate transfer belt 44*b*, the sheet S is conveyed through a conveyance path to the secondary transfer portion 45. Further, image is transferred from the intermediate transfer belt 44*b* to the sheet S, and the sheet S is conveyed to the fixing portion 46, where unfixed toner image is heated and pressed and fixed to the surface of the sheet S, before the sheet S is discharged from the apparatus body 10.

Figure 3:
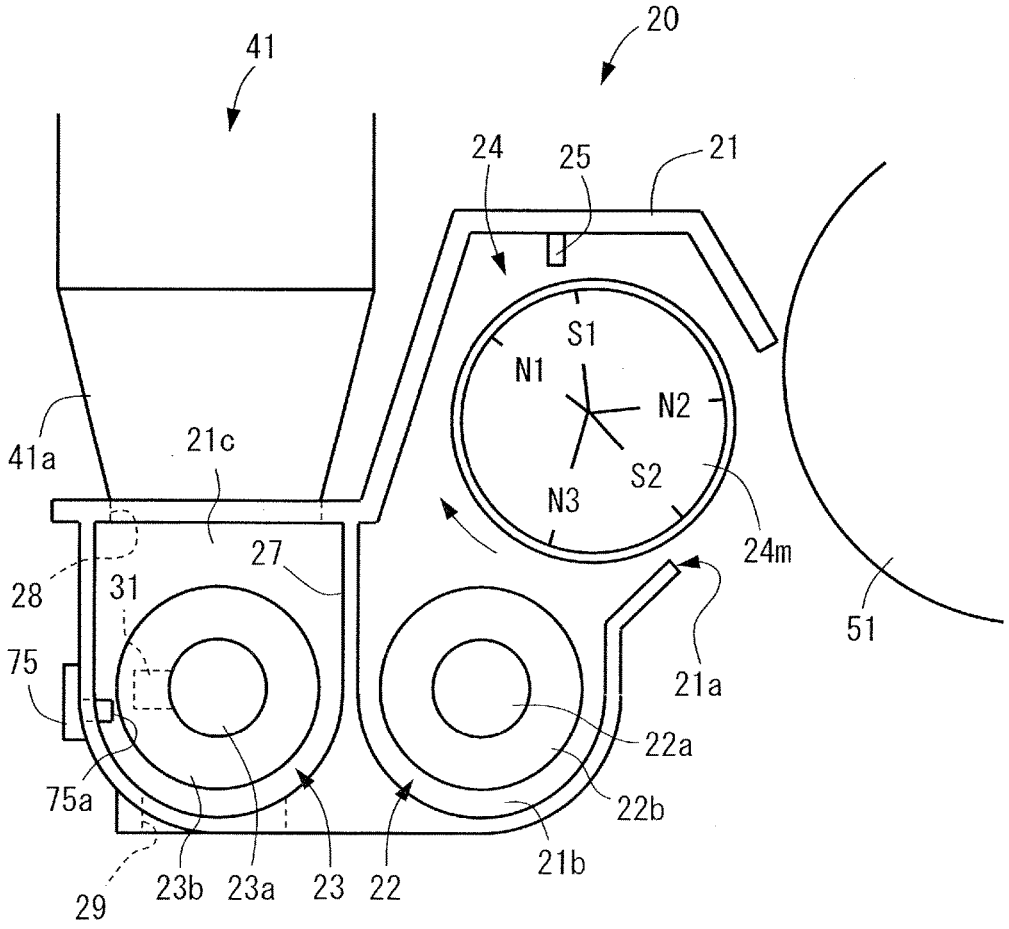
FIG. 3 is a cross-sectional view illustrating a schematic configuration of a developing apparatus according to the embodiment.
Figure 4:
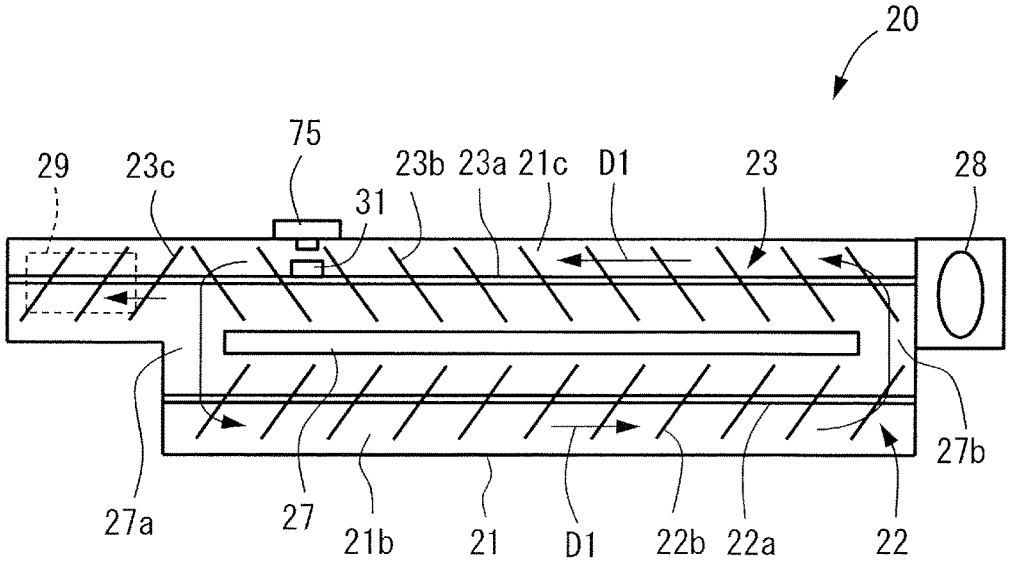
FIG. 4 is a plan view illustrating a circulation path of the developing apparatus according to the embodiment.

Next, the developing apparatus 20 will be described in detail with reference to FIGS. 3 and 4. The developing apparatus 20 includes a developer container 21 storing developer, a first conveyance screw 22, a second conveyance screw, serving as a conveyance portion, 23, a developing sleeve 24, a regulation member 25, and a density detection sensor, serving as a density detection unit, 75. The developing apparatus 20 stores the developer, and develops the electrostatic image formed on the photosensitive drum 51. The developer container 21 includes an opening portion 21*a* through which the developing sleeve 24 is exposed at a position facing the photosensitive drum 51. The present embodiment adopts a cylindrical developing sleeve 24, but the shape is not restricted thereto, and a flexible belt can be applied, for example.

The developer container 21 includes a partition wall 27 arranged approximately at a center portion and extending in a longitudinal direction. The developer container 21 is divided in a horizontal direction by the partition wall 27 into a developing chamber 21*b* and an agitating chamber 21*c*. The developer is stored in the developing chamber 21*b* and the agitating chamber 21*c*. The developing chamber 21*b* supplies the developer to the developing sleeve 24. The agitating chamber 21*c* is communicated with the developing chamber 21*b*, and the developer from the developing sleeve 24 is collected and agitated. Two communicating portions 27*a* and 27*b* are formed on both ends of the partition wall 27 formed between the developing chamber 21*b* and the agitating chamber 21*c*, communicating the developing chamber 21*b* and the agitating chamber 21*c*. According to the developing apparatus 20 of the present embodiment, the developing chamber 21*b* and the agitating chamber 21*c* are arranged in the horizontal direction, but the arrangement is not restricted thereto, and the developing apparatus can be formed in other ways, such as the developing chamber and the agitating chamber being arranged one above the other.

The first conveyance screw 22 is arranged in the developing chamber 21*b* substantially in parallel with the developing sleeve 24, and conveys the developer in the developing chamber 21*b* while agitating the developer. The first conveyance screw 22 includes a shaft portion 22*a* disposed rotatably in the developer container 21 with its axial direction Da arranged in a longitudinal direction, and a spiral-shaped conveying blade 22*b* rotated integrally with the shaft portion 22*a* and conveying the developer within the developer container 21 to a conveyance direction D1 of the developer along rotation.

The second conveyance screw 23 is arranged within the agitating chamber 21*c* approximately in parallel with the first conveyance screw 22, and conveys the developer within the agitating chamber 21*c* to an opposite direction as the first conveyance screw 22. The second conveyance screw 23 includes a shaft portion 23*a* disposed rotatably in the developer container 21, and a spiral-shaped conveying blade 23*b* rotated integrally with the shaft portion 23*a* and conveying the developer within the developer container 21 to the conveyance direction D1 along rotation. The developing chamber 21*b* and the agitating chamber 21*c* constitute a circulation path of the developer for conveying the developer while agitating the developer. The toner being agitated by the respective screws 22 and 23 is frictionally electrified to negative polarity by being rubbed with the carrier.

A return screw 23*c* is provided on a downstream end portion of the second conveyance screw 23 in the conveyance direction D1. A return screw 23*c* conveys the developer to a direction opposite to the conveyance direction D1 along rotation. In the agitating chamber 21*c*, a large part of the developer conveyed from the upstream side is pushed back by the return screw 23*c* and conveyed from the communicating portion 27*a* to the developing chamber 21*b*. A discharge port opening downward is formed on a downstream end portion of the agitating chamber 21*c* in the conveyance direction D1 of the developer, and the excessive developer in the agitating chamber 21*c* is pushed over the return screw 23*c* and discharged through the discharge port 29 to a discharge device not shown.

A supply port 28 opening upward is formed at an upstream end portion of the agitating chamber 21*c* in the conveyance direction D1 of the developer, and a hopper 41*a* of a toner bottle 41 is connected to the supply port 28. The hopper 41*a* stores a two-component developer for replenishment in which toner and carrier are mixed (usually, the ratio of toner/developer for replenishment is 100% through 80%). The toner supplied from the toner bottle 41 is replenished from the hopper 41*a* via the supply port 28 to the agitating chamber 21*c*. The hopper 41*a* has a screw-shaped replenishing screw not shown disposed at a lower portion therein, by which the developer can be supplied from the replenishing screw to the supply port 28. The amount of the replenishment developer replenished from the hopper 41*a* to the developer container 21 is roughly determined by the number of rotations of the replenishing screw. The number of rotations is determined by the controller 70 based on, for example, a video count value of image data or the detection result of the density detection sensor 75 disposed in the developer container 21.

The developing sleeve 24 bears the developer including nonmagnetic toner and magnetic carrier, and conveys the developer to an image developing region facing the photosensitive drum 51. The developing sleeve 24 is formed of a nonmagnetic material such as aluminum and nonmagnetic stainless steel, and in the present embodiment, it is formed of aluminum. A roller-shaped magnet roller 24*m* is disposed in a fixed manner in a non-rotating state with respect to the developer container 21 on the inner side of the developing sleeve 24. The magnet roller 24*m* has a plurality of magnetic poles N1, S1, N2, S2 and N3 on the surface thereof.

The developer within the developing apparatus 20 is borne on the developing sleeve 24 by the magnet roller 24*m*. Thereafter, layer thickness of the developer on the developing sleeve 24 is regulated by the regulation member 25, and along the rotation of the developing sleeve 24, the developer is conveyed to the image developing region facing the photosensitive drum 51. In the image developing region, the developer on the developing sleeve 24 is raised in a bristle state, and forms magnetic bristles. In a state where the magnetic bristles are in contact with the photosensitive drum 51, the toner is supplied to the photosensitive drum 51, and the electrostatic latent image on the photosensitive drum 51 is developed as toner image.

The density detection sensor 75 is attached to an outer side of the developer container 21, and arranged such that a detection surface 75*a* is exposed to an inner side of the developer container 21 through a through-hole 21*d* (refer to FIG. 5) formed on a side wall of the agitating chamber 21*c* of the developer container 21. The position of exposure of the detection surface 75*a* of the density detection sensor 75 inside the developer container 21 is lower than a center line of the shaft portion 23*a*. The density detection sensor 75 is connected to the controller 70 (refer to FIG. 2), and the detection surface 75*a* exposed within the developer container 21 is arranged to face the second conveyance screw 23, configured to detect the density of the developer conveyed within the agitating chamber 21*c* of the developer container 21, and transmit electric signals to the controller 70.

In the present embodiment, a permeability sensor is used as the density detection sensor 75. The permeability sensor determines the density of the toner in the developer (referred to also as a 'toner density' hereinafter) by detecting an apparent change of permeability of the developer (detecting inductance) that drops if the toner density of the developer is increased. Upon computing the toner density, the controller 70 samples multiple points of output value of the permeability sensor, acquires the means of the samples, and takes out a DC component of the output value of the permeability sensor by cancelling vibrational components, for example. Then, the controller 70 calculates the toner density by referring to a table prepared by checking the relationship of the value and the toner density in advance.

Figure 7A:
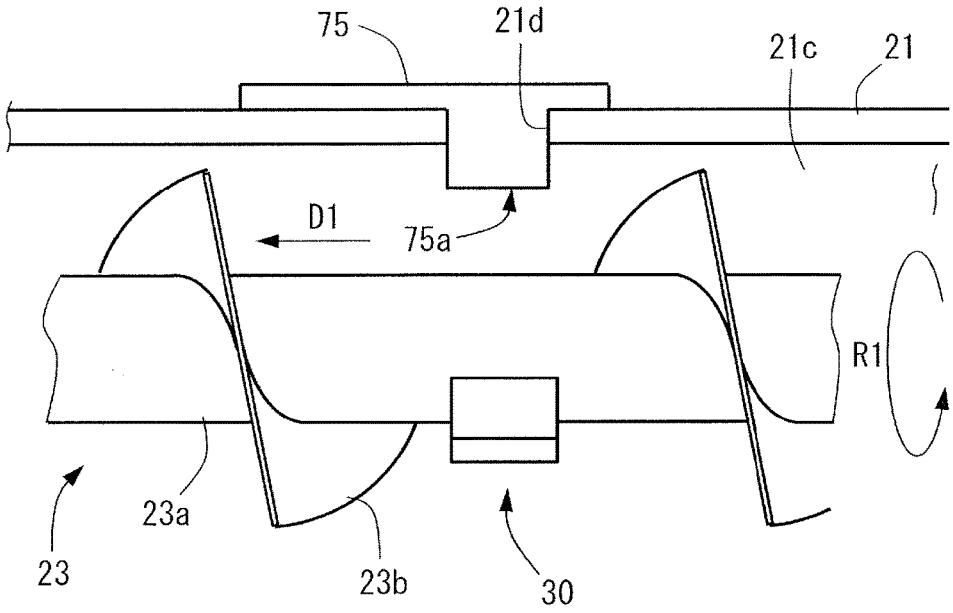
FIG.7A (Prior Art)
FIG. 7A is a plan view illustrating a density detection sensor according to a conventional developing apparatus.

Now, as illustrated in FIG. 7A, we will describe a case in which a plate-like agitating panel 30 is disposed on a detection region of the detection surface 75*a* of the density detection sensor 75 on the shaft portion 23*a* of the second conveyance screw 23. That is, a plate-like agitating panel 30 is disposed on a region facing the detection surface 75*a* of the density detection sensor 75 such that a gap is formed between the conveying blade 23*b* and the agitating panel 30 so as to agitate the developer of the detection region of the density detection sensor 75 and stabilize the detection result preferably. However, a gap is formed between the detection surface 75*a* of the density detection sensor 75 and the agitating panel 30, and the developer existing in the gap does not receive a large amount of force acting to convey the developer in a direction of rotation R1 of the conveying blade 23*b*, and the force acts in a direction pressing the developer onto the detection surface 75*a* of the density detection sensor 75. Thereby, unmovable developer accumulates near a surface of the detection surface 75*a*, and especially if the developer is deteriorated and the fluidity of the developer is decreased, the developer is even more easily accumulated.

Figure 7B:
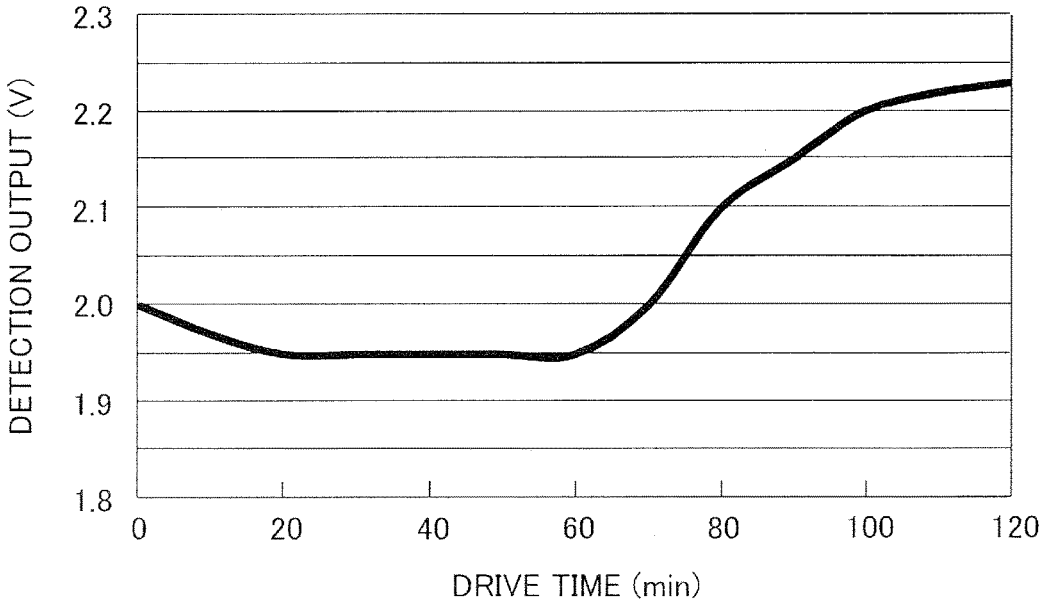
FIG.7B (Prior Art)
FIG. 7B is a graph illustrating a relationship between drive time of the developing apparatus and detection output of the density detection sensor according to the conventional developing apparatus.

The developing apparatus 20 equipped with the second conveyance screw 23 having the agitating panel 30 illustrated in FIG. 7A was used, and the apparatus was continuously driven in a state where a fixed toner density is maintained without consuming or replenishing toner, to detect the transition of output value of the density detection sensor 75. The result is illustrated in FIG. 7B. As illustrated in FIG. 7B, from the start to 20 minutes after start of operation, the amount of charge was increased by friction of the toner and carrier, and bulk density of the developer was decreased, such that the detection output was reduced. Thereafter, from 20 to 60 minutes after start of operation, the amount of charge of the toner was stabilized, and the detection output was also stabilized. However, from 60 minutes and thereafter, deterioration of the developer lead to the increase of detection output.

In a state where fluidity of the developer was high up to 60 minutes from start of operation, the developer was conveyed without being accumulated at the detection surface 75*a* of the density detection sensor 75, and the output was stable. Thereafter, however, the deterioration of the developer causes accumulation of the developer, by which the detection output is increased, causing erroneous detection and excessive replenishment of toner, and possibly inducing image defects such as fogging. If accumulation of the developer occurs near the detection surface 75*a* of the density detection sensor 75, even if fluidity of the developer is improved by repeated consumption and replenishment of the developer, it is difficult to demolish the accumulation of developer in the gap formed between the detection surface 75*a* and the agitating panel 30 and convey the accumulated developer, so that erroneous detection may not be solved. Recently, there are cases where the density detection sensor 75 is provided below the developer container 21 for downsizing of the image forming apparatus, and erroneous detection due to the accumulation of developer on the detection surface 75*a* of the density detection sensor 75 may occur more significantly.

Therefore, according to the present embodiment, an agitating portion, serving as a projected portion, 31 is provided to the shaft portion 23*a* of the second conveyance screw 23, the agitating portion 31 configured to remove the accumulation of developer on the detection surface 75*a* of the density detection sensor 75 and enable detection of density of the developer with high accuracy. The following describes the configuration of the agitating portion 31 in detail.

Figure 5A:
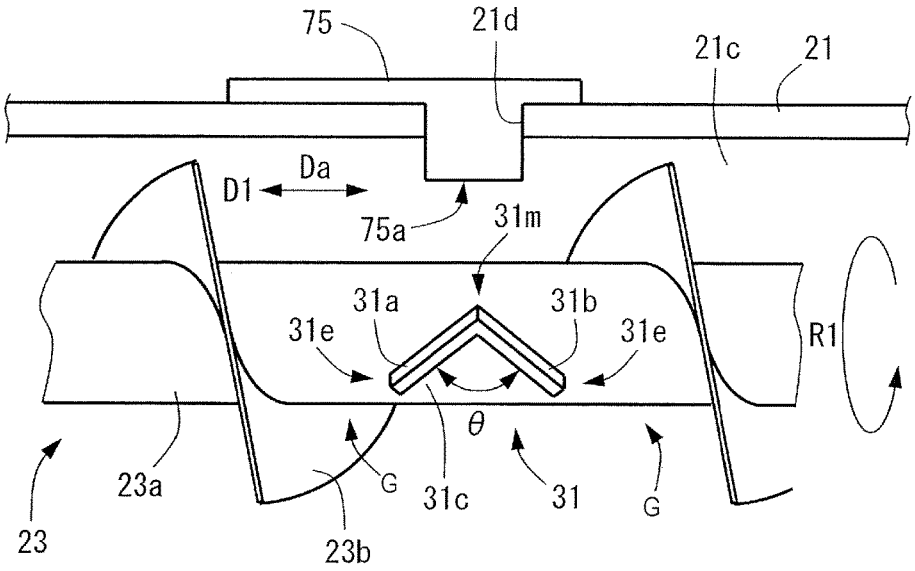
FIG. 5A is a plan view illustrating the density detection sensor and an agitating portion in the developing apparatus according to the embodiment.

As illustrated in FIG. 5A, the agitating portion 31 is provided to protrude in the radial direction from the shaft portion 23*a* of the second conveyance screw 23 facing the detection surface 75*a*. The agitating portion 31 includes a downstream side portion, serving as a first side portion, 31*a* and an upstream side portion, serving as a second side portion, 31*b*, which are disposed continuously in the axial direction Da. The downstream side portion 31*a* is inclined so as to convey the developer in an opposite direction as the conveyance direction D1 along the rotation of the second conveyance screw 23. The upstream side portion 31*b* is inclined so as to convey the developer in the conveyance direction D1 along the rotation of the second conveyance screw 23. That is, the downstream side portion 31*a* is inclined to be further upstream in the direction of the rotation R1 as the downstream side portion 31*a* extends upstream in the conveyance direction D1. The upstream side portion 31*b* is inclined, from an upstream end portion of the downstream side portion 31*a* in the conveyance direction D1, to be further downstream in the direction of the rotation R1 of the conveyance portion as the upstream side portion 31*b* extends upstream in the conveyance direction D1. The downstream side portion 31*a* and the upstream side portion 31*b* may be fixed by methods such as bonding, welding, press-fitting and the like of a separate member to the shaft portion 23*a*, or they may be formed integrally when the second conveyance screw 23 is formed. That is, the agitating portion 31 is provided such that it is overlapped with the position of the detection surface 75*a* in the axial direction Da, and protruded from the shaft portion 23*a* in the radial direction.

The downstream side portion 31*a* and the upstream side portion 31*b* are communicated at an upstream portion in a direction of rotation R1. That is, the agitating portion 31 is designed such that a part 31*m* between both end portions 31*e* in the axial direction Da is positioned further upstream in the direction of rotation R1 than the both end portions 31*e*. Therefore, when viewed from a radial direction of the shaft portion 23*a*, the agitating portion 31 opens in a downstream side in the direction of rotation R1 and outward in the radial direction, and forms a concave portion 31*c* having a concaved shape closing in an upstream side in the direction of rotation R1. The concave portion 31*c* is arranged such that a width, in the axial direction Da, of a region surrounded by a line connecting the both end portions 31*e* and the concave portion 31*c* is narrowed from a downstream side toward an upstream side in the direction of the rotation R1. That is, viewed from the radial direction, the concave portion 31*c* has a width in the axial direction Da in the inner side region of the part 31*m* and the both end portions 31*e* that is narrowed from the downstream side toward the upstream side in the direction of rotation R1. Thereby, the agitating portion 31 collects the developer in a direction of rotation R1 along rotation of the second conveyance screw 23 so that the collected developer pushes and agitates a developer between the second conveyance screw 23 and the detection surface 75*a* of the density detection sensor 75. Further, the collected developer can push the developer existing between the second conveyance screw 23 and the density detection sensor 75 toward the direction of rotation R1, and agitate the developer.

In the present embodiment, a shaft diameter of the shaft portion 23*a* of the second conveyance screw 23 is 8 mm, an outer diameter of the conveying blade 23*b* is 16 mm, and a 1-mm clearance is provided between the conveying blade 23*b* and the inner wall of the developer container 21. Further, the detection surface 75*a* of the density detection sensor 75 is protruded by 2 mm from the inner wall of the developer container 21. Both the downstream side portion 31*a* and the upstream side portion 31*b* have a thickness of 1 mm in a direction along a circumferential surface of the shaft portion 23*a*, a height of 6 mm from a center to the shaft portion 23*a*, a height of 2 mm from the circumferential surface of the shaft portion 23*a*, and a 1-mm gap between the detection surface 75*a* of the density detection sensor 75.

The downstream side portion 31*a* and the upstream side portion 31*b* are connected, forming an obtuse angle θ of approximately $90° < \theta \leq 120°$. Therefore, the developer collected by the agitating portion 31 easily falls from a corner portion between the downstream side portion 31*a* and the upstream side portion 31*b*, such that the developer is suppressed from being aggregated at the corner portion and mixing with other developer.

The agitating portion 31 is arranged with a gap G between the conveying blade 23*b* of the second conveyance screw 23. Thereby, the developer collected at the time when the agitating portion 31 is positioned above the shaft portion 23*a* of the second conveyance screw 23 drops from the agitating portion 31, and the developer is conveyed by the second conveyance screw 23, according to which the aggregation of the collected developer is suppressed.

The operation of the second conveyance screw 23 being rotated to agitate and convey the developer in the above-described developing apparatus 20 will be described. As illustrated in FIG. 5A, the developer stored in the agitating chamber 21*c* is conveyed in the conveyance direction D1 while being agitated along the rotation of the second conveyance screw 23. The agitating portion 31 collects the surrounding developer through rotation, and agitates the developer while pushing and collecting the developer toward the density detection sensor 75. Thereby, the collected developer pushes and removes the developer accumulated near the detection surface 75*a* of the density detection sensor 75 either directly or by shearing. That is, the agitating portion 31 is configured in such a shape that the collected developer does not escape from the agitating portion 31 in an axial direction Da and is pushed outward in a radial direction of the second conveyance screw 23 along the rotation of the second conveyance screw 23, and the agitating portion 31 pushes the collected developer in the radial direction and removes the accumulated developer on the detection surface 75*a* of the density detection sensor 75. The pushed developer is conveyed in the conveyance direction D1 by the conveying blade 23*b* of the second conveyance screw 23 adjacent to the agitating portion 31.

As described, according to the developing apparatus of the present embodiment, in a state where the second conveyance screw 23 is rotated, the developer is collected by the concaved part of the agitating portion 31. Then, the agitating portion 31 and the collected developer act to push the developer accumulated near the detection surface 75*a* of the density detection sensor 75 along with the rotation of the second conveyance screw 23. Thereby, the developer accumulated near the detection surface 75*a* of the density detection sensor 75 is either pushed directly or sheared. Thus, the accumulated developer on the detection surface 75*a* of the density detection sensor 75 can be removed, and the density of the developer can be detected with high accuracy.

According to the developing apparatus 20 of the present embodiment, the agitating portion 31 is formed of the downstream side portion 31*a* and the upstream side portion 31*b*. Therefore, the agitating portion 31 can be realized with a simple configuration, and the increase in size or complication of design of the agitating portion 31 can be suppressed.

Further according to the developing apparatus 20 of the present embodiment, the downstream side portion 31*a* and the upstream side portion 31*b* are connected to form an obtuse angle θ. Therefore, in a state where the agitating portion 31 is positioned above the shaft portion 23*a*, the developer collected by the agitating portion 31 easily falls from the corner portion between the downstream side portion 31*a* and the upstream side portion 31*b*, such that the developer can be suppressed from being aggregated at the corner portion and mixing into the other developer.

Figure 5B:
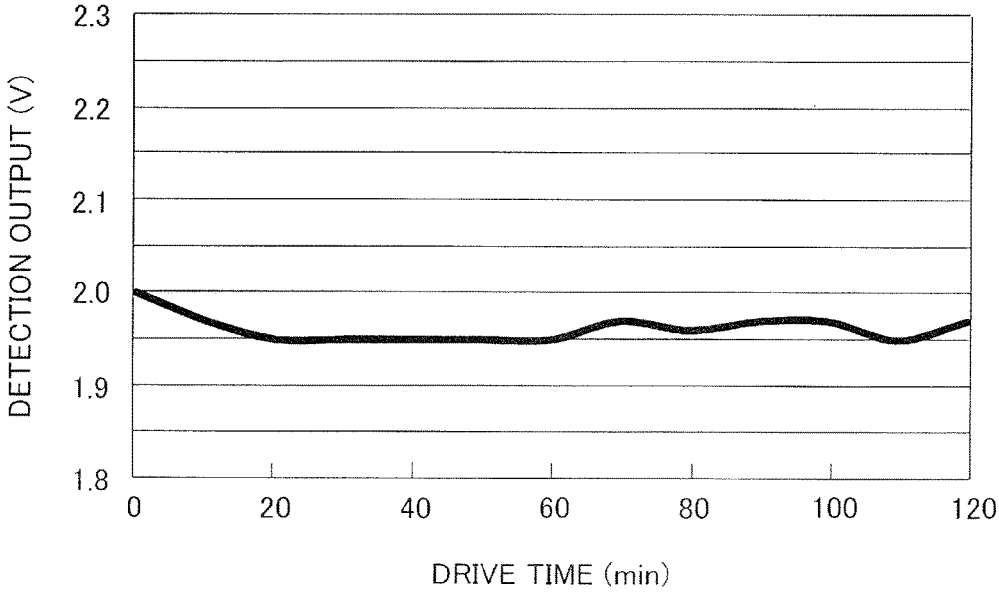
FIG. 5B is a graph illustrating a relationship between drive time of the developing apparatus and detection output of the density detection sensor in the density detection sensor of the developing apparatus according to the embodiment.

Now, the developing apparatus 20 equipped with the second conveyance screw 23 having the agitating portion 31 illustrated in FIG. 5A was driven continuously while maintaining a fixed toner density without consuming or replenishing toner, and transition of output value of the density detection sensor 75 was detected. The result is illustrated in FIG. 5B. As illustrated in FIG. 5B, even after elapse of 60 minutes from the start of the operation, the detection output was stable without erroneous detection. Therefore, by providing the agitating portion 31, it has been confirmed that compared to the case where the agitating panel 30 is provided, the accumulation of developer on the detection surface 75*a* of the density detection sensor 75 is removed, and density of the developer is detected with high accuracy.

Figure 6A:
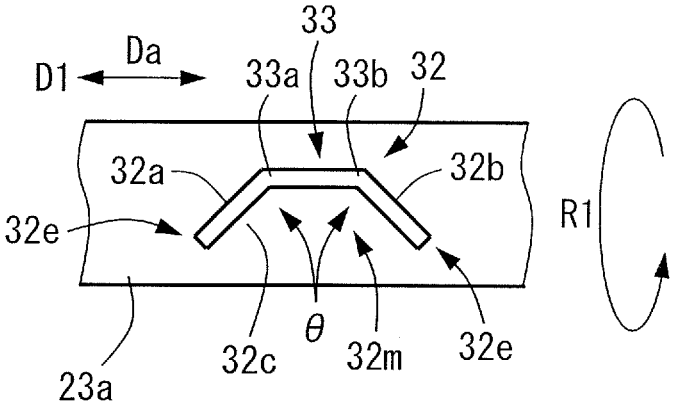
FIG. 6A is a plan view illustrating an agitating portion adopting another shape as an alternative example of the agitating portion in the developing apparatus according to the embodiment.

The developing apparatus 20 of the present embodiment described above illustrated an example in which the agitating portion 31 of the second conveyance screw 23 was composed of the downstream side portion 31*a* and the upstream side portion 31*b*, but the present invention is not restricted to this configuration. For example, as illustrated in FIG. 6A, an agitating portion, serving as a projected portion, 32 can have a downstream side portion, serving as a first side portion, 32*a*, a connecting portion 33, and an upstream side portion, serving as a second side portion, 32*b*, which are disposed continuously from the downstream side toward the upstream side in the conveyance direction D1. The connecting portion 33 is disposed along the axial direction of the shaft portion 23*a*. The downstream side portion 32*a* is connected to a downstream end portion 33*a* of connecting portion 33 in the conveyance direction D1, and inclined so as to convey the developer to an opposite direction as the conveyance direction D1 along the rotation of the second conveyance screw 23. That is, the downstream side portion 32*a* is inclined to be further downstream in the direction of the rotation R1 as the downstream side portion 32*a* extends downstream in the conveyance direction D1. The upstream side portion 32*b* is connected to an upstream end portion 33*b* of the connecting portion 33 in the conveyance direction D1, and inclined so as to convey the developer to the conveyance direction D1 along the rotation of the second conveyance screw 23. That is, the upstream side portion 32*b* is inclined to be further downstream in the direction of the rotation R1 as the upstream side portion 32*b* extends upstream in the conveyance direction D1. Further, the agitating portion 32 is arranged with a gap S formed between the conveying blade 23*b* of the second conveyance screw 23. The agitating portion 32 has a concave portion 32*c* designed such that a part 32*m* between both end portions 32*e* in the axial direction Da is positioned upstream in the direction of rotation R1 than the both end portions.

Also according to this case, in a state where the second conveyance screw 23 is rotated, developer is collected by the concave portion 32*c* of the agitating portion 32, and the developer accumulating near the detection surface 75*a* of the density detection sensor 75 is either directly pushed or sheared. Therefore, the accumulation of developer on the detection surface 75*a* of the density detection sensor 75 can be removed, and the density of the developer can be detected highly accurately. Even further, since the connecting portion 33 is disposed along the axial direction of the shaft portion 23*a*, a greater amount of developer can be collected by the agitating portion 32 compared to the configuration without the connecting portion 33, and the accumulation of the developer on the detection surface 75*a* of the density detection sensor 75 can be removed more effectively.

Further according to the agitating portion 32 illustrated in FIG. 6A, at least either the downstream side portion 32*a* or the upstream side portion 32*b* and the connecting portion 33 are arranged to form an obtuse angle θ of approximately $90° < \theta \leq 120°$. Therefore, in a state where the agitating portion 32 is positioned above the shaft portion 23*a*, the developer collected by the agitating portion 32 easily falls from the corner portion of the obtuse angle, such that the developer can be suppressed from being aggregated at the corner portion and mixing with other developer.

Figure 6B:
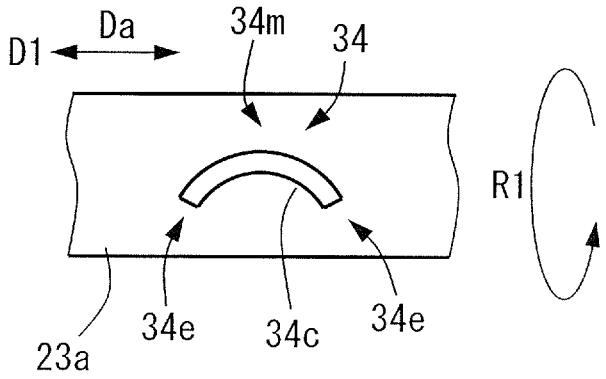
FIG. 6B is a plan view illustrating an agitating portion adopting yet another shape as an alternative example of the agitating portion in the developing apparatus according to the embodiment.

According further to the developing apparatus 20 of the above-described embodiment, the agitating portion 31 of the second conveyance screw 23 is composed of multiple plate-shaped side portions, but the present embodiment is not restricted thereto. For example, as illustrated in FIG. 6B, an agitating portion, serving as the projected portion, 34 can be formed in a curved shape or an arc shape when viewed from the radial direction. In this case, the agitating portion 34 has a concave portion 34*c* shaped so that a part 34*m* between both end portions 34*e* in the axial direction Da is positioned upstream in the direction of rotation R1 than the both end portions 34*e*. The concave portion 34*c* is configured in such an arc shape that a width, in the axial direction Da, of a region surrounded by a line connecting both end portions 34*e* and the concave portion 34*c* is narrowed from a downstream side toward an upstream side in the direction of the rotation R1. In another example, the agitating portion can be formed in a channel shape having a downstream side portion and an upstream side portion arranged along the direction of rotation R1, and a connecting portion arranged along the axial direction Da connecting the upstream side portions thereof in the direction of rotation R1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-170336, filed Aug. 31, 2016, which is hereby incorporated by reference wherein in its entirety.

What is claimed is:

1. A developing apparatus comprising:

a developer bearing member configured to bear and convey a developer containing toner and carrier to a developing position where the developer bearing member develops an electrostatic image formed on an image bearing member;

a developer container configured to circulate the developer being supplied to the developer bearing member between a first chamber and a second chamber divided from the first chamber by a partition wall;

a first communicating portion configured to permit the developer in the first chamber to be communicated from the first chamber to the second chamber;

a second communicating portion configured to permit the developer in the second chamber to be communicated from the second chamber to the first chamber;

a first conveyance screw arranged in the first chamber and configured to convey the developer in the first chamber in a first direction from the second communicating portion to the first communicating portion;

a second conveyance screw arranged in the second chamber and configured to convey the developer in the second chamber in a second direction from the first communicating portion to the second communicating portion; and a permeability sensor configured to detect a permeability of the developer accommodated in the developer container for detecting a density of the developer accommodated in the developer container, the permeability sensor comprising a base portion and a detection portion which is arranged on the base portion along the second direction and is configured to detect the permeability of the developer accommodated in the developer container, wherein the detection portion is arranged below a rotational axis of the second conveyance screw when the developer bearing member is positioned at the developing position, and wherein a rib portion formed so as to protrude in a radial direction from a rotation shaft of the second conveyance screw for supplying the developer toward the detection portion is arranged at an area on the second conveyance screw overlapping with the detection portion in the second direction, the rib portion being arranged between a blade portion of the second conveyance screw and an adjacent blade portion, and wherein the shortest distance between the rib portion and the detection portion at a first portion of the rib portion is longer than the shortest distance between the rib portion and the detection portion at a second portion of the rib portion and is longer than the shortest distance between the rib portion and the detection portion at a third portion of the rib portion, the first portion of the rib portion being provided downstream in the second direction of the second portion of the rib portion and upstream in the second direction of the third portion of the rib portion, when the rib portion being positioned at a position where the rib portion is supplying the developer toward the detection portion is viewed in a direction perpendicular to a rotational axis direction of the second conveyance screw.

2. The developing apparatus according to claim 1, wherein the rib portion comprises a first rib portion comprising the second portion of the rib portion and a second rib portion, connecting with the first rib portion via the first portion of the rib portion, comprising the third portion of the rib portion, when the rib portion being positioned at a position where the rib portion supplies the developer toward the detection portion is viewed in a direction perpendicular to a rotational axis direction of the second conveyance screw, an angle θ, being an obtuse angle, formed by the first rib portion and the second rib portion is greater than 90 degrees and 120 degrees or smaller.

3. The developing apparatus according to claim 1, wherein the rib portion comprises a first rib portion comprising the second portion of the rib portion, a second rib portion comprising the third portion of the rib portion, and a connecting portion, connecting the first rib portion with the second rib portion, comprising the first portion of the rib portion, when the rib portion being positioned at a position where the rib portion supplies the developer toward the detection portion is viewed in a direction perpendicular to a rotational axis direction of the second conveyance screw, an angle θ1, being an obtuse angle, formed by the connecting portion and the first rib portion is greater than 90 degrees and 120 degrees or smaller, and an angle θ2, being an obtuse angle, formed by the connecting portion and the second rib portion is greater than 90 degrees and 120 degrees or smaller.

4. The developing apparatus according to claim 1, wherein the permeability sensor is attached to the developer container in a state that the detection portion penetrates an opening portion of the developer container, and at least a part of the detection portion is arranged in the second chamber.

5. The developing apparatus according to claim 1, wherein a rotation direction of the second conveyance screw is a direction in which the developer is conveyed from a bottom portion of the second chamber toward a side wall portion opposed to the partition wall without being conveyed toward the partition wall.

6. The developing apparatus according to claim 1, wherein the first conveyance screw is configured to convey the developer in the first chamber to the first direction and supply the developer in the first chamber to the developer bearing member.

* * * * *